US008606141B2

(12) United States Patent
Furuya et al.

(10) Patent No.: US 8,606,141 B2
(45) Date of Patent: Dec. 10, 2013

(54) IMAGE FORMING APPARATUS OPERABLE FOR INSTALLING ATTACHABLE/DETACHABLE CARTIDGE THEREIN

(75) Inventors: Norio Furuya, Numazu (JP); Yuusuke Niikawa, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 237 days.

(21) Appl. No.: 13/074,951

(22) Filed: Mar. 29, 2011

(65) Prior Publication Data

US 2011/0243601 A1 Oct. 6, 2011

(30) Foreign Application Priority Data

Mar. 31, 2010 (JP) ..... 2010-082830
Feb. 7, 2011 (JP) ..... 2011-024020

(51) Int. Cl.
*G03G 21/18* (2006.01)
*G03G 15/00* (2006.01)

(52) U.S. Cl.
USPC ..... 399/110

(58) Field of Classification Search
USPC ..... 399/110, 111, 114
See application file for complete search history.

(56) References Cited

U.S. PATENT DOCUMENTS 5,983,054 A * 11/1999 Kameyama ..... 399/125
6,229,974 B1 5/2001 Noda

FOREIGN PATENT DOCUMENTS

JP 2000-293087 A 10/2000
JP 2005-077615 A 3/2005
JP 2005-242213 A 9/2005

* cited by examiner

*Primary Examiner* — Quana M Grainger
(74) *Attorney, Agent, or Firm* — Canon USA Inc IP Division

(57) ABSTRACT

An image forming apparatus includes an arm member. The arm member includes a cartridge abutment surface configured to abut the cartridge when the cartridge moves from a state in which the cartridge is at the attached position to a state in which the cartridge is detached from the main body, an opening and closing member abutment surface configured to abut the opening and closing member when the cartridge moves from the state in which the cartridge is at the attached position to the state in which the cartridge is detached from the main body to press the cartridge abutment surface, the opening and closing member abutment surface being substantially parallel to the cartridge abutment surface, and a force transmission portion extending in a direction normal to the cartridge abutment surface to linearly connect between the cartridge abutment surface and the opening and closing member abutment surface.

12 Claims, 8 Drawing Sheets

IMAGE FORMING APPARATUS OPERABLE FOR INSTALLING ATTACHABLE/DETACHABLE CARTIDGE THEREIN

BACKGROUND OF THE INVENTION

1. Field of the Invention

The present invention relates to an image forming apparatus for forming an image on a recording medium and discharging the same. In particular, the present invention relates to an image forming apparatus in which components needing replacement as the apparatus is used are formed into a cartridge which is attachable to and detachable from a main body of the apparatus.

2. Description of the Related Art

An image forming apparatus of such a type has an opening and closing cover configured to rotate to open the interior of a main body of the apparatus for the attachment/detachment of the cartridge. Japanese Patent Application Laid-Open No. 2005-242213 discusses an image forming apparatus whose opening and closing cover is provided with a push-in member for pushing in the cartridge to a proper position as the opening and closing cover is closed.

The cartridge push-in member also serves to abut the cartridge to hold the same so that the cartridge may not get out of the image forming apparatus due to a shock, vibration or the like applied to the apparatus when the apparatus is being transported with the cartridge attached to the apparatus. The shock the cartridge push-in member receives from the cartridge when the cartridge push-in member abuts the cartridge to hold the same is absorbed by the cartridge push-in member (hereinafter referred to as the push-in member) itself and the opening and closing cover. However, in the construction discussed in Japanese Patent Application Laid-Open No. 2005-242213, a moment is generated around the portion of the push-in member connected with the opening and closing cover as a result of the cartridge abutting the push-in member. Thus, high strength is required of the push-in member so that it can withstand fracture due to this moment. To secure such high strength, it is necessary to increase the wall thickness of the push-in member or to provide it with a reinforcing structure such as a reinforcing rib, thus resulting in an increase in size and cost.

SUMMARY OF THE INVENTION

The present invention is directed to an image forming apparatus with respect to which a cartridge is detachable, wherein there is provided a cartridge holding mechanism which exhibits a sufficient level of strength while suppressing an increase in size and cost.

According to an aspect of the present invention, an image forming apparatus having a main body to which a cartridge is attachable and detachable thereto, the image forming apparatus performing image formation with the cartridge mounted at an attached position, includes an opening and closing member configured to rotate with respect to the main body to move between a closed position where the main body is closed and an opened position where the main body is open to allow attachment/detachment of the cartridge, and an arm member configured to rotate in conjunction with the rotation of the opening and closing member and capable of pushing the cartridge to move the cartridge to the attached position when the opening and closing member rotates from the opened position toward the closed position, wherein the arm member includes a cartridge abutment surface configured to abut the cartridge when the cartridge moves from a state in which the cartridge is at the attached position toward a state in which the cartridge is detached from the main body, an opening and closing member abutment surface configured to abut the opening and closing member when the cartridge moves from the state in which the cartridge is at the attached position toward the state in which the cartridge is detached from the main body to press the cartridge abutment surface, the opening and closing member abutment surface being substantially parallel to the cartridge abutment surface, and a force transmission portion extending in a direction normal to the cartridge abutment surface to linearly connect between the cartridge abutment surface and the opening and closing member abutment surface.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

In the following, an exemplary embodiment of the present invention will be described in detail with reference to the drawings. The dimensions, materials, and configurations of the components of the exemplary embodiment described below and their positional relationship, etc., are to be changed as appropriate according to the construction of the apparatus to which the present invention is applied, and the various conditions involved. Thus, unless otherwise specified, the scope of the present invention is not to be construed as restricted thereto.

An image forming apparatus according to a first exemplary embodiment of the present invention will be described with reference to FIGS. 1 through 5. The image forming apparatus of the present exemplary embodiment is a laser beam printer with respect to which a process cartridge is detachable.

Figure 1:
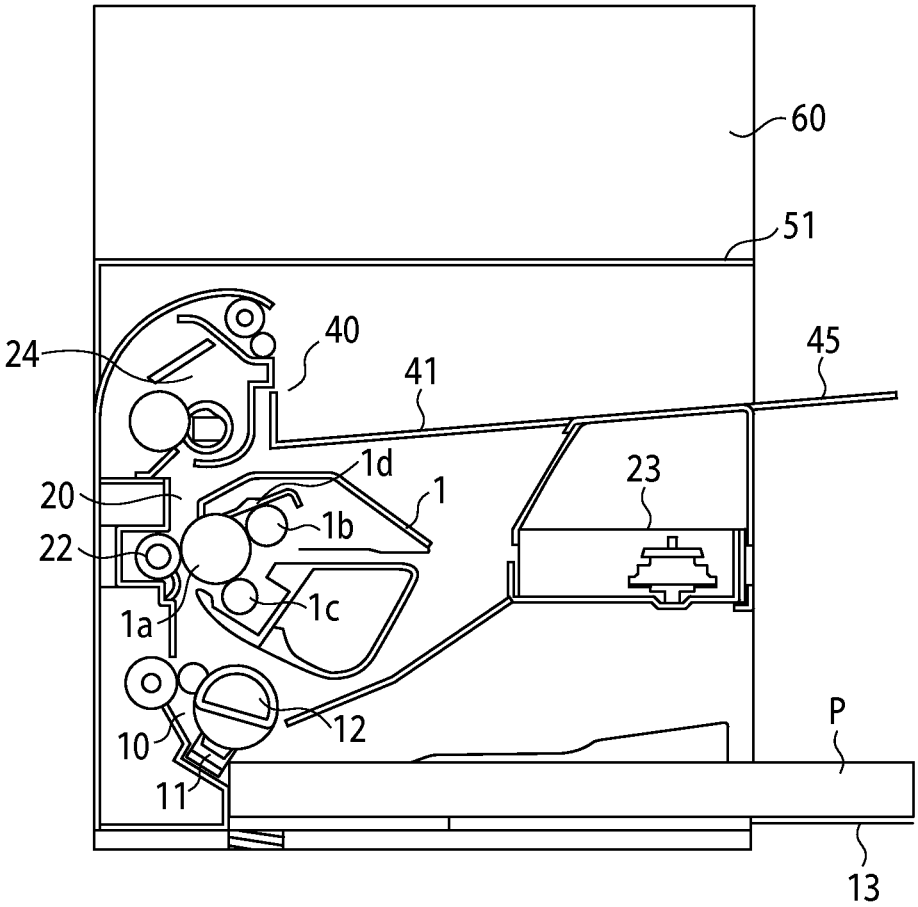
FIG. 1 is a sectional view as seen from the left-hand side of an image forming apparatus.

First, the general construction of the image forming apparatus will be schematically described. FIG. 1 is a schematic sectional view, as seen from the left-hand side, of the image forming apparatus of the first exemplary embodiment.

In the following, the front surface of the apparatus refers to the right-hand side surface in FIG. 1, that is, the surface on the side where a paper feeding tray 13 protrudes from the apparatus external surface. The longitudinal direction of the process cartridge (the axial direction of the photosensitive drum) is the direction normal to the plane of the diagram. As illustrated in FIG. 1, the image forming apparatus includes a paper feeding unit 10, an image forming unit 20, and a paper discharge unit 40. On the image forming apparatus, there is placed an image scanner 60 for reading a document image.

First, the image forming apparatus will be described. The paper feeding unit 10 separates from each other sheets of recording paper P stacked on a paper feeding tray 13 by means of a paper feeding roller 12 and a separation pad 11, and conveys them to the image forming unit 20. The image forming unit 20 includes a process cartridge 1, a transfer roller 22, a laser exposure device 23, and a thermal heating type fixing device 24. The process cartridge 1 includes a photosensitive drum 1*a*, and a charging roller 1*b*, a development roller 1*c*, and a cleaning blade 1*d* constituting a process unit acting on the photosensitive drum 1*a*. Next, the image forming process will be described. While the photosensitive drum 1*a* is rotating, a toner image is formed on the surface thereof by the process unit. First, the photosensitive drum 1*a* is charged by the charging roller 1*b*, and a laser beam corresponding to image information is applied to the photosensitive drum 1*a* by the laser exposure device 23, thereby forming a latent image on the photosensitive drum 1*a*. Next, toner retained by the development roller 1*c* is caused to adhere to the surface of the photosensitive drum 1*a* to make the latent image visible as a toner image. When the recording paper P passes a transfer nip formed between the transfer roller 22 and the photosensitive drum 1*a*, a transfer bias is applied to transfer the toner image on the photosensitive drum 1*a* onto the recording paper P. The recording paper P to which the toner image has been transferred is conveyed to the fixing device 24, where heat and pressure are applied to fix the toner image before the recording paper P is discharged from the paper discharge unit 40 to be stacked on a paper discharge tray 45. After the recording paper has passed the transfer nip, the toner remaining on the surface of the photosensitive drum 1*a* is wiped off by the cleaning blade 1*d*.

Figure 2A:
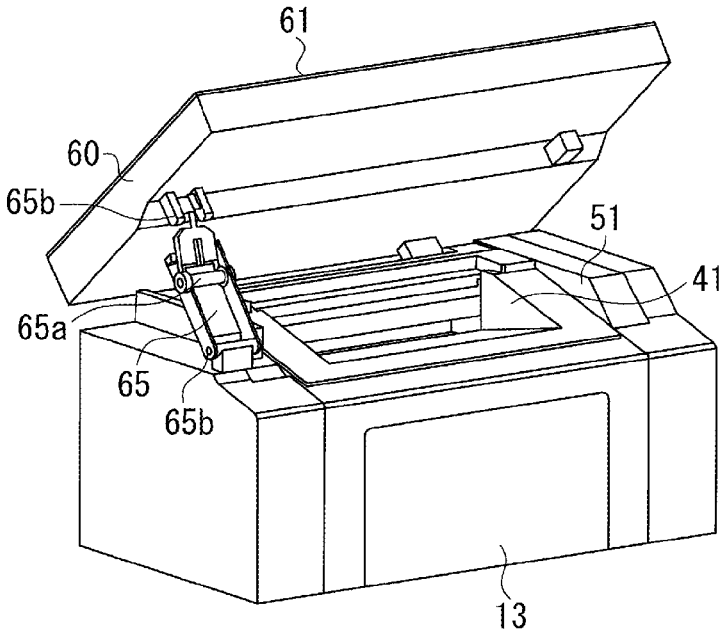
FIG. 2A is a perspective view of the image forming apparatus with a cover member of an image scanner closed.
Figure 2B:
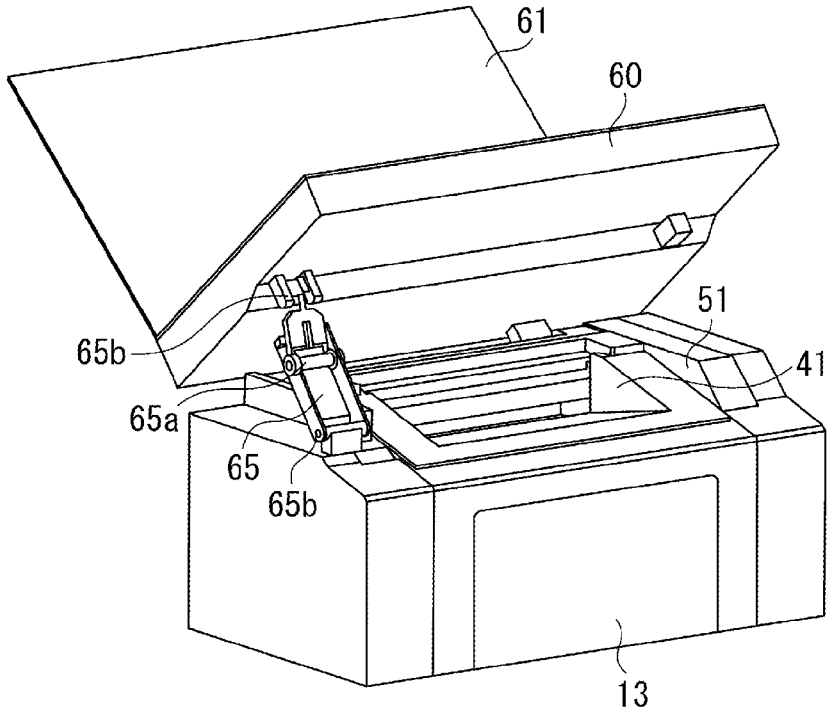
FIG. 2B is a perspective view of the image forming apparatus with the cover member of the image scanner open.

FIGS. 2A and 2B are perspective views of the image forming apparatus with the image scanner 60 open after being rotated. In FIG. 2A, a cover member 61 of the image scanner 60 is closed, and, in FIG. 2B, the cover member 61 of the image scanner 60 is open. The image scanner 60 is installed above the fixing device 24 and the paper discharge unit 40 of the image forming apparatus through the intermediation of a top cover 51.

In FIGS. 2A and 2B, the paper feeding tray 13 is closed; the front surface of the apparatus refers to the surface on the side where the paper feeding tray 13 exists.

The image scanner 60 can be opened and closed with respect to the image forming apparatus; it is configured to be rotated obliquely upwards with respect to the main body. On the upper surface of the image forming apparatus, there is provided an opening and closing cover 41 configured to be rotated obliquely upwards with respect to the main body and capable of moving between a closed position where the apparatus is closed and an opened position where the interior of the apparatus is open to allow the attachment/detachment of the process cartridge 1. At the time of attachment/detachment, etc., of the process cartridge 1, the opening and closing cover 41 is opened with the image scanner 60 open after being rotated. As illustrated in FIGS. 2A and 2B, the image scanner 60 is joined to the top cover 51 via a scanner link 65. The scanner link 65 can be opened and closed around a scanner link opening/closing shaft 65*a*, and both distal end portions 65*b* thereof are rotatably retained by the image scanner 60 and the top cover 51. As a result, according to the opening/closing angle of the scanner link 65, the opening angle of the image scanner 60 with respect to the image forming apparatus is uniquely determined. When the image scanner 60 is opened to an excessive degree, or when the image scanner 60 is excessively opened, with the cover member 61, which is attached to the image scanner 60, being open, the center of gravity of the image scanner 60 as a whole is shifted excessively backwards. As a result, there is a fear of the image forming apparatus main body falling backwards. To prevent this, the opening angle of the image scanner 60 with respect to the image forming apparatus is restricted to a range not allowing the scanner link 65 to cause the main body to fall.

The opening and closing cover 41 is configured to rotate within the space obtained by opening the image scanner 60. In other words, the image scanner 60 is situated in an extension of the movement path of the opening and closing cover 41. Thus, when the opening angle of the image scanner 60 is restricted, the amount by which the opening and closing cover 41 can rotate with respect to the image forming apparatus main body is also restricted. In the case where a push-in portion is integrally formed with the opening and closing cover 41, when the rotating amount of the opening and closing cover 41 is small, it is impossible for the push-in portion to withdraw from the movement path at the time of attachment/detachment of the process cartridge 1, thus resulting in deterioration in usability.

In view of this, in the present exemplary embodiment, there is provided a push-in member having a rotation center different from a rotation center 41*c* of the opening and closing cover 41 and configured to rotate in conjunction with the opening and closing cover 41. In the state in which the opening and closing cover 41 is at the opened position, this push-in member withdraws from the movement path at the time of attachment/detachment of the process cartridge 1 with respect to the push-in portion provided integrally. While in this example the rotation of the opening and closing cover 41 implies the rotation of the opening and closing cover 41 around a predetermined axis (rotation center 41*c*), this should not be construed restrictively. It will also be possible to employ a form in which the opening and closing cover 41 moves substantially parallel around a predetermined axis while maintaining its attitude.

Figure 3A:
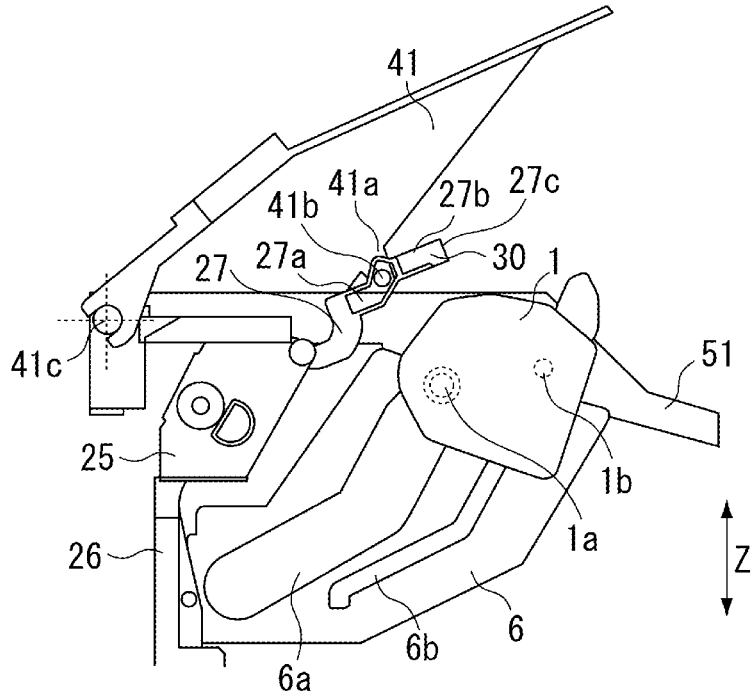
FIG. 3A is a sectional view, as seen from the left-hand side, of the portion of the image forming apparatus around a process cartridge and an opening and closing cover, with the opening and closing cover open to allow attachment/detachment of the process cartridge.
Figure 3B:
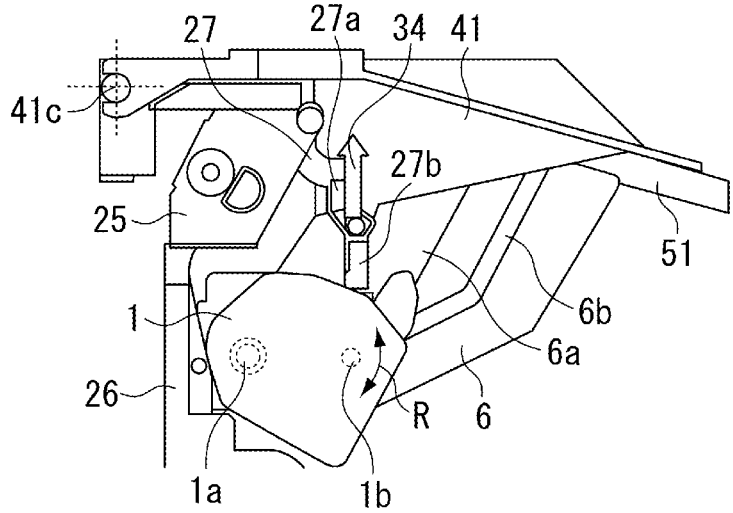
FIG. 3B is a sectional view, as seen from the left-hand side, of the portion of the image forming apparatus around the process cartridge and the opening and closing cover, with the opening and closing cover closed after completion of the attachment of the process cartridge.
Figure 4:
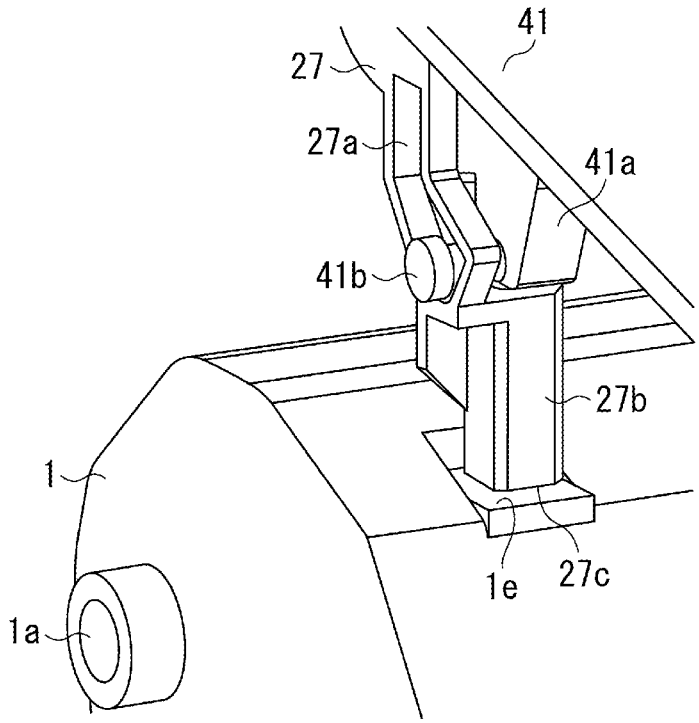
FIG. 4 is a perspective view of the portion of the image forming apparatus around a connection arm, with the process cartridge attached and the opening and closing cover closed.

Next, the cartridge push-in member will be described in detail. FIGS. 3A and 3B are sectional views, as seen from the left-hand side, of the portion of the image forming apparatus around the process cartridge 1 and the opening/closing lever 41. The longitudinal direction of the process cartridge 1 (the axial direction of the photosensitive drum) is the direction normal to the plane of the diagram. FIG. 3A is a sectional view of the portion of the apparatus in the state in which the opening and closing cover 41 is open to allow attachment/detachment of the process cartridge 1, and FIG. 3B is a sectional view of the portion of the apparatus in the state in which the opening and closing cover 41 is closed after completion of the attachment of the process cartridge 1. FIG. 4 is a perspective view of the portion of the apparatus around a connection arm 27 when the opening and closing cover 41 is closed after completion of the attachment of the process cartridge. In the following description, depiction and illustration of the components that are irrelevant thereto will be omitted. As illustrated in FIG. 3A, there is a protrusion 41*a* near either end portion in the longitudinal direction of the process cartridge 1 of the opening and closing cover 41, and, further on, there is provided a joint portion 41*b*. The joint portion 41*b* is fit-engaged with a rail portion 27*a* of the connection arm 27, which is the cartridge push-in member, to be connected to the connection arm 27. The connection arm 27 is rotatably retained by a fixing frame 25 constituting the frame of the fixing device 24. Thus, as the opening and closing cover 41 is opened or closed, the joint portion 41*b* moves within the rail portion 27*a* while fit-engaged therewith, causing the connection arm 27 to rotate.

Cartridge guides 6 are respectively mounted to the main body inner sides of the right-hand and left-hand side plates of the image forming apparatus. The cartridge guides 6 are located on both sides of the process cartridge 1 as viewed in the direction perpendicular to the drawing surface of FIGS. 3A and 3B. FIGS. 3A and 3B illustrate only the cartridge guide 6 attached to the right-hand side plate of the image forming apparatus. The movement path and attitude within the main body of the process cartridge 1 are determined through fit-engagement of two bosses 1*a* and 1*b* provided at each of the right-hand and left-hand ends of the process cartridge 1 with two rails 6*a* and 6*b* provided at each of the cartridge guides L (not illustrated) and 6.

As the process cartridge 1 is inserted and moved into the main body, the boss 1*a* abuts the lower end of the rail 6*a*, and the boss 1*b* moves in the Z-direction in FIG. 3A to abut the lower end of the rail portion 6*b*, with the process cartridge 1 reaching the attached position where an image forming operation is performed. In the state in which the process cartridge 1 is at the attached position, the boss 1*b* can move in the Z-direction while guided by the rail 6*b*, with the boss 1*b* being held in contact with the lower end of the rail 6*a*. Thus, the process cartridge 1 is provided with play so that it may move in the direction R in FIG. 3B using the boss 1*a* as a fulcrum at the attached position.

At the time of image formation, a drive force is imparted to the photosensitive drum 1, whereby the process cartridge 1 itself is urged downwardly in the direction R, and the boss 1*b* abuts the lower end of the rail 6*b*, placing the process cartridge 1 in a state in which it is set in place at the attached position.

As illustrated in FIG. 3A, when the opening and closing cover 41 is fully open, the connection arm 27 has been rotated upwards and withdrawn to the outside of the movement path of the process cartridge 1 at the time of attachment/detachment of the process cartridge 1. As the process cartridge 1 is attached and the opening and closing cover 41 is closed as illustrated in FIGS. 3B and 4, the connection arm 27 rotates downwardly in conjunction therewith. With this rotation, a cartridge receiving surface (cartridge abutment surface) 27*c*, which is apart of the cartridge push-in portion 27*b*, comes close to the process cartridge 1 so as to block the movement path of the process cartridge 1. Further, an opening and closing cover abutment surface (opening and closing member abutment surface) 27*d* of the connection arm 27 comes close to a protrusion 41*a* of the opening and closing cover 41. When attaching the process cartridge 1 to the image forming unit 20 of the apparatus, it is necessary to open the opening and closing cover 41, and insert the process cartridge 1 into the main body to install (position) it at the attached position. Even if the insertion of the process cartridge 1 into the main body can only be effected to an insufficient degree, the cartridge push-in portion 27*b* of the connection arm 27 rotating with the operation of closing the opening and closing cover 41 pushes the process cartridge 1. This makes it possible to push the process cartridge 1 to the attached position. In the state in which the process cartridge 1 has been installed (positioned) at the attached position, with the opening and closing cover 41 being closed, there is a gap between the cartridge push-in portion 27*b* and the process cartridge 1, and the connection arm 27 and the process cartridge 1 do not abut each other.

Figure 5:
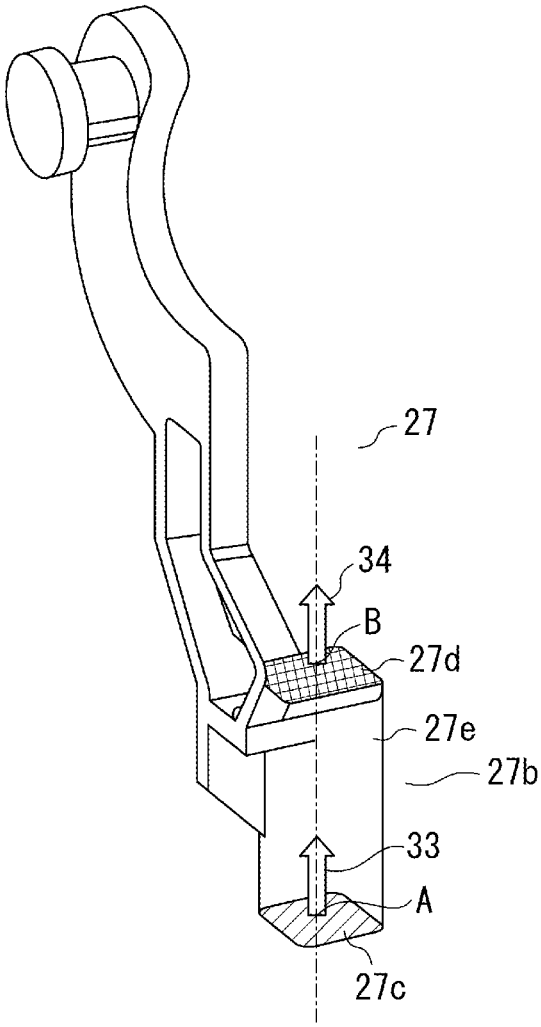
FIG. 5 is a perspective view of the connection arm.

Next, the construction of the connection arm 27 will be described in more detail. FIG. 5 is a perspective view of the connection arm 27. As illustrated in FIG. 5, the opening and closing cover abutment surface 27*d* is substantially parallel to the cartridge receiving surface 27*c*. The center point B of the opening and closing cover abutment surface 27*d* is substantially situated in the normal to the center point A of the cartridge receiving surface 27*c*. Further, the cartridge push-in portion 27*b* has a force transmission portion 27*e* for transmitting the force received by the cartridge receiving surface 27*c* in the normal direction to the opening and closing cover abutment surface 27*d*. More specifically, the force transmission portion 27*e* extends in the direction normal to the center point A of the cartridge receiving surface 27*c*, linearly connecting between the cartridge receiving surface 27*c* and the opening and closing cover abutment surface 27*d*.

The center point A of the cartridge receiving surface 27*c* is an in-surface point to be regarded as a representative point receiving a force when expressing the force applied to the cartridge receiving force 27*c* as a vector. That is, in the case where a force is uniformly applied to the surface, the center point A coincides with the center of gravity of the surface. Similarly, the center point B is an in-surface point to be regarded as a representative point on the opening and closing cover abutment surface 27*d* which is regarded to be receiving the force when expressing the force the opening and closing cover abutment surface 27*d* applies to the protrusion 41*a* of the opening and closing cover as a vector.

The image forming apparatus is shipped and transported while packed in an individual package box, with the process cartridge attached to the main body, and the image scanner 60 and the opening and closing cover 41 closed. During this transport, the individual package box may receive a particularly great shock by being shaken or dropped, so that an acceleration may be applied to the attached process cartridge 1, which strives to move away from the main body (in the direction R). In this process, the process cartridge 1 strikes the cartridge receiving surface 27*c* blocking the movement path. The process cartridge 1 has an abutment surface 1*e*, which is substantially parallel to the cartridge receiving surface 27*c* and located opposite the cartridge receiving surface 27*c* in a state where the process cartridge 1 is attached at the attached position with the opening and closing cover 41 being closed. When the process cartridge 1 moves away from the main body, the abutment surface 1*e* moves substantially vertically with respect to the cartridge receiving surface 27*c* to strike the cartridge receiving surface 27*c*.

Then, due to this striking, a large stress 33 is applied to the cartridge push-in portion 27*b* in a direction perpendicular to the cartridge receiving surface 27*c*. The cartridge push-in portion 27*b* has the cartridge receiving surface 27*c*, the opening and closing cover abutment surface 27*d*, and the force transmission portion 27*e*, which are arranged in the above-described positional relationship. More specifically, the force transmission portion 27*e* extends substantially parallel to the direction of the force the cartridge receiving surface 27*c* receives from the process cartridge 1 (the direction perpendicular to the cartridge receiving surface 27*c*) to linearly effect connection between the cartridge receiving surface 27*c* and the opening and closing cover abutment surface 27*d*. Thus, the stress 33 applied to the cartridge receiving surface 27*c* is transmitted through the force transmission portion 27*e* substantially in the direction normal to the center point A of the cartridge receiving surface 27*c* before reaching the opening and closing cover abutment surface 27*d*. Thus, as illustrated in FIG. 5, the stress vector 33 the connection arm 27 receives from the process cartridge 1 and the stress vector 34 the opening and closing cover protrusion 41*a* receives from the connection arm 27 are substantially in the same straight line.

The stress vector 33 represents the force applied to the cartridge receiving surface 27*c* as a vector from the center point A, which is the same with the stress vector 34. The force the cartridge receiving surface 27*c* receives from the process cartridge 1 is the resultant force of the force in the direction normal to the center point A of the cartridge receiving surface 27*c* and a frictional force the cartridge receiving surface 27*c* receives from the abutment surface 1*e*. However, this frictional force is sufficiently small as compared with the force in the direction normal to the center point A of the cartridge receiving surface 27*c*, and is negligible.

In this way, the stress received by the cartridge receiving surface 27*c* is transmitted to the opening and closing cover abutment surface 27*d* via the force transmission portion 27*e*, and is then transmitted directly to the protrusion 41*a* of the opening and closing cover 41. Thus, there is no need for the connection arm 27 to positively absorb the stress; the stress is absorbed by the high rigidity of the opening and closing cover 41 itself.

Further, of the forces applied to the connection arm 27, the force in the direction of the normal at the center point of the cartridge receiving surface 27*c* is predominant over the force generating the moment around the joint portion 41*b* of the opening and closing cover 41. Thus, it is to be assumed that no moment around the joint portion 41*b* of the opening and closing cover 41 is substantially generated in the connection arm 27. Thus, it is only necessary for the connection arm 27 to be strong enough to withstand the stress in the direction of the normal at the center point of the cartridge receiving surface 27*c*.

Generally, of the requisite stresses for breaking a rigid body on a column, the stress applied in the axial direction of the column is larger than the stress for applying to the column a moment around a line perpendicular to the axis of the column. In other words, if the force applied to the column is the same, it is possible to break the column with a smaller force when a force is applied so as to generate a moment around a line perpendicular to the axis of the column than when a force is applied in the axial direction of the column. Thus, it is not necessary for the connection arm 27 of the present exemplary embodiment to have a strength high enough to withstand a moment around the joint portion 41*b* of the opening and closing cover 41; it is only necessary for the connection arm 27 to be strong enough to withstand the force in the direction normal to the center point of the cartridge receiving surface 27*c*. Thus, there no need to increase the wall thickness of the force transmission portion 27*e* between the cartridge receiving surface 27*c* and the opening and closing cover abutment surface 27*d* or to provide a reinforcing member or the like in order to enhance the strength of the connection arm 27. Thus, it is possible to form the connection arm 27 as a small and inexpensive component.

It is only necessary for the opening and closing cover abutment surface 27*d* to be substantially parallel to the cartridge receiving surface 27*c*; it need not be strictly parallel thereto. Further, it is only necessary for the center point B of the opening and closing cover abutment surface 27*d* to be substantially situated in the normal to the center point A of the cartridge receiving surface 27*c*; the effect of the present invention can be attained even if it is not strictly in the normal. Further, it is only necessary for the force transmission portion 27*e* to be of a construction allowing transmission of the force received by the cartridge receiving portion 27*c* to the opening and closing cover abutment surface 27*d* substantially in the direction normal to the cartridge receiving surface 27*c*; the effect of the present invention can be achieved even if it is not strictly in the direction of the normal. Further, the force transmission portion 27*e* can provide the effect of the present invention so long as it has a portion linearly connecting the cartridge receiving surface 27*c* and the opening and closing cover abutment surface 27*d* in the direction normal to the cartridge receiving surface 27*c*. That is, the portion linearly connecting the cartridge receiving surface 27*c* and the opening and closing cover abutment surface 27*d* in the direction normal to the cartridge receiving surface 27*c* implies a portion formed so as to connect between a point on the cartridge receiving surface 27*c* and a point on the opening and closing cover abutment surface 27*d* and to include a segment (limited straight line) parallel to the direction normal to the cartridge receiving surface 27*c*.

The cartridge guides L and 6 are formed such that when the process cartridge 1 is at the attached position, the process cartridge 1 moves in the direction in which the force transmission portion 27*e* extends to abut the cartridge receiving surface 27*c*. The direction in which the force transmission portion 27*e* extends is a direction in which the force transmission portion 27*e* linearly connects the cartridge receiving surface 27*c* and the opening and closing cover abutment surface 27*d*; in the present exemplary embodiment, it coincides with the direction normal to the center point of the cartridge receiving surface 27*c*. That is, the direction in which the process cartridge 1 moves when it is detached from the attached position, i.e., the main body (right-hand upward direction), and the direction in which the force transmission portion 27*e* extends (the direction of the arrow 34 in FIG. 3B), substantially coincide with each other. By thus forming the cartridge guides L and 6, it is possible to hold the process cartridge 1 more efficiently.

By forming the connection arm 27 as described above, it is possible to provide a cartridge push-in mechanism with a sufficient level of strength while suppressing an increase in size and cost.

Figure 6A:
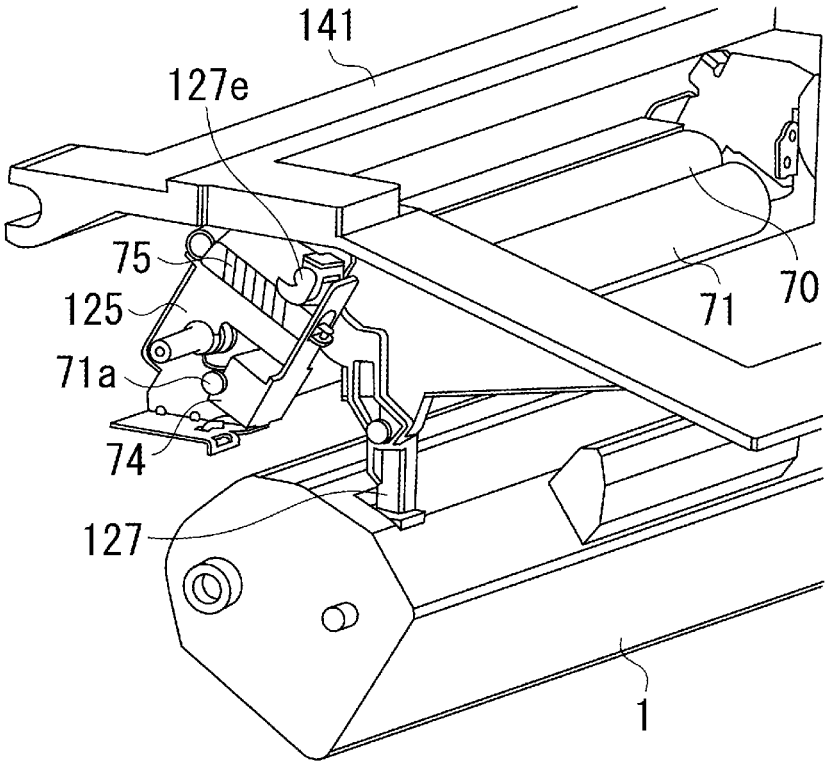
FIG. 6A is a perspective view of the portion of the image forming apparatus around the process cartridge, the opening and closing cover, and the connection arm.
Figure 6B:
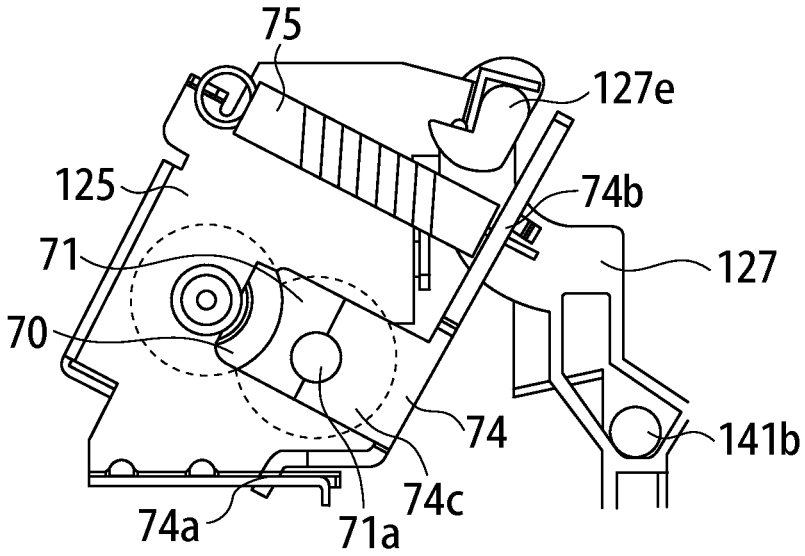
FIG. 6B is a sectional view, as seen from the left-hand side, of the portion of the image forming apparatus around the process cartridge, the opening and closing cover, and the connection arm, with the opening and closing cover closed.
Figure 6C:
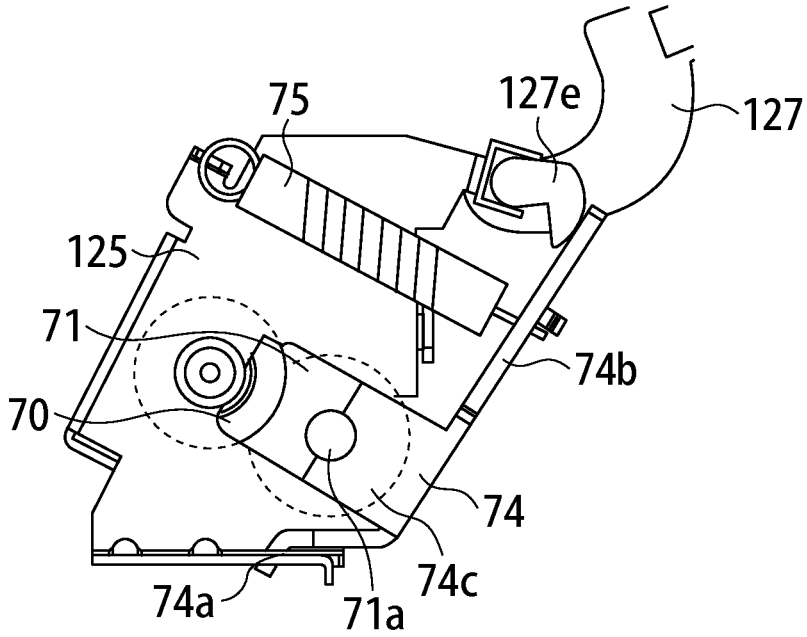
FIG. 6C is a sectional view, as seen from the left-hand side, of the portion of the image forming apparatus around the process cartridge, the opening and closing cover, and the connection arm, with the opening and closing cover open.

Next, an image forming apparatus according to a second exemplary embodiment of the present invention will be described with reference to FIGS. 6A through 6C. In the present exemplary embodiment, the members and components having functions equivalent to those of the first exemplary embodiment described above are indicated by the same reference numerals, and a description thereof will be omitted. FIGS. 6A through 6C illustrate the portion of the apparatus near an opening and closing cover 141, the process cartridge 1, and the fixing device. FIG. 6A is a perspective view illustrating the state in which the opening and closing cover 141 is closed, FIG. 6B is a sectional view, as seen from the left-hand side, of the apparatus with the opening and closing cover 141 closed, and FIG. 6C is a sectional view, as seen from the left-hand side, of the apparatus with the opening and closing cover 141 open. Here, depiction and illustration of the components that are irrelevant to the following description are omitted.

When jamming occurs with the paper P caught at the heating nip of the fixing device, it is necessary to release the heat nipping pressure in order to achieve an improvement in terms of usability in dealing with jamming. In the following, a heat nipping releasing mechanism utilizing a part of a connection arm 127 will be schematically described.

As illustrated in FIGS. 6A through 6C, inside the fixing device, a pressurizing roller 70 is rotatably retained by a fixing frame 125, and a heating unit 71 is arranged opposite thereto. At both end portions of the heating unit 71, there are provided pressure receiving shafts 71*a*, and these portions are retained by a fixing pressurization arm pressing portion 74*c*, and are, at the same time, pressed toward the pressurizing roller 70. One end 74*a* of a fixing pressurization arm 74 is inserted into the fixing frame 125, and the fixing pressurization arm 74 is swingable toward the pressurizing roller 70 around the inserted end 74*a*. Further, the fixing pressurization arm 74 is provided with a pressurization spring mounting portion 74*b*, and a pressurization spring 75 is mounted between this portion and the fixing frame 125. As a result, the fixing pressurization arm 74 is constantly urged toward the pressurizing roller 70 integrally with the heating unit 71 via the heating unit pressure receiving shafts 71*a*, whereby the heating unit 71 and the pressurizing roller 70 are held in press contact with each other to form a heating nip. One end 127*e* of the connection arm 127 is rotatably held between the fixing frame 125 and the fixing pressurization arm 74, thus forming a rotation center of the connection arm 127. Further, this portion is of a cam configuration.

As illustrated in FIG. 6B, when the opening and closing cover 141 is closed, the connection arm end portion 127*e* and the fixing pressurization arm 74 are not in contact with each other, and the urging force of the pressurization spring 75 is being applied solely to the fixing pressurization arm 74. In this case, the contact pressure between the heating unit 71 and the pressurizing roller 70 depends upon the urging force of the pressurization spring 75. In contrast, when, as illustrated in FIG. 6C, the opening and closing cover 141 is open, a cam-shaped portion of the connection arm end portion 127*e* abuts the fixing pressurization arm 74, pressing it down in a direction opposite to the pressurizing roller 70. In this case, the contact pressure between the heating unit 71 and the pressurizing roller 70 depends on the abutment position between the connection arm end position 127*e* and the fixing pressurization arm 74, and does not depend on the urging force of the pressurization spring 75. Thus, by adjusting this abutment position through the cam configuration of the connection arm end portion 127*e* to place the opening and closing cover 141 in the open state, it is possible to release the heat nipping pressure.

As described above, in the present exemplary embodiment, it is possible to provide a cartridge push-in mechanism with a sufficient level of strength while suppressing an increase in size and cost as in the first exemplary embodiment. Further, since the connection arm 127 also serves as the heat nipping releasing mechanism, it is possible to omit the components the mechanism would otherwise require, thereby achieving a reduction in cost.

Figure 7A:
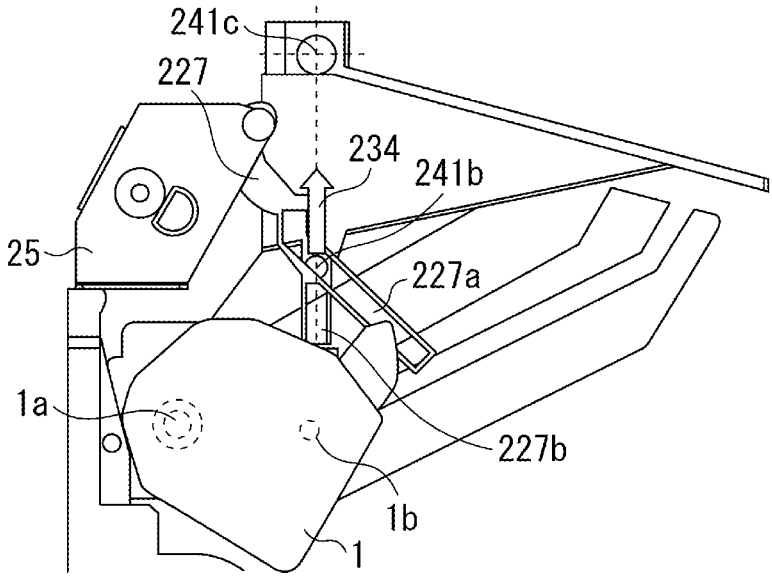
FIG. 7A is a sectional view, as seen from the left-hand side, of the portion of the image forming apparatus around the process cartridge and the opening and closing cover, with the opening and closing cover closed after completion of the attachment of the process cartridge.
Figure 7B:
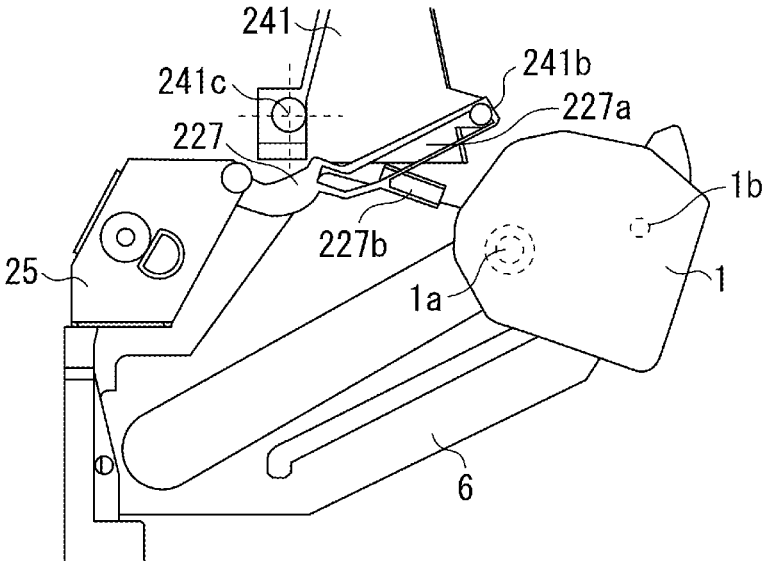
FIG. 7B is a sectional view, as seen from the left-hand side, of the portion of the image forming apparatus around the process cartridge and the opening and closing cover, with the opening and closing cover open to allow attachment/detachment of the process cartridge.

Next, referring to FIGS. 7A and 7B, an image forming apparatus according to a third exemplary embodiment of the present invention will be described. In the present exemplary embodiment, the members and components having functions equivalent to those of the first and second exemplary embodiments described above are indicated by the same reference numerals, and a description thereof will be omitted. FIGS. 7A and 7B are sectionals views, as seen from the left-hand side, of the portion of the apparatus around the process cartridge and the opening and closing cover. FIG. 7A is a sectional view of the portion in a state in which an opening and closing cover 241 is closed after completion of the attachment of the process cartridge, and FIG. 7B is a sectional view of the portion in a state in which the opening and closing cover 241 is open to allow attachment/detachment of the process cartridge. Here, depiction and illustration of the components that are irrelevant to the following description are omitted. As illustrated in FIGS. 7A and 7B, as compared with the first exemplary embodiment, the third exemplary embodiment mainly differs in the position of a rotation center 241*c* of the opening and closing cover 241 and in the configuration of a rail portion 227*a* of a connection arm 227.

During transport of the individually packed image forming apparatus, a stress may be exerted to the opening and closing cover 241 from the process cartridge 1 via the connection arm 227. In the first exemplary embodiment illustrated in FIGS. 3A and 3B, the position of the opening and closing cover rotation center 41*c* is shifted backwards (to the left in FIGS. 3A and 3B) with respect to the extension of the stress vector 34 the opening and closing cover receives. In this case, due to the upward pressurization force (directed upwards as seen in FIGS. 3A and 3B) attributable to this stress, a counterclockwise rotational moment is applied to the opening and closing cover 41. That is, a force is applied in the direction in which the opening and closing cover 41 opens, so that even if the opening and closing cover 41 is held by the package material or the like, it may occur that the opening and closing cover 41 is slightly opened. When the opening and closing cover 41 opens, the space in which the process cartridge 1 can move within the main body increases, so that there is a possibility of the bosses 1*a* and 1*b* of the process cartridge 1 being detached from the rail portions 6*a* and 6*b* of the cartridge guides L and 6. Thus, to prevent the opening and closing cover 41 from being opened, some measures may be required.

In contrast, as illustrated in FIG. 7A, in the third exemplary embodiment, the rotation center 241*c* of the opening and closing cover 241 is provided substantially in the extension of a stress vector 234 exerted on the opening and closing cover 241 from the connection arm 227. Thus, there is generated no moment around the rotation center of the opening and closing cover 241. Thus, it is possible to reduce the possibility of the opening and closing cover 241 being opened by this stress. Further, an upward pressurization force is applied solely to the rotation center 241*c* of the opening and closing cover 241, so that the rigidity of the portion thereof other than the rotation center may be low, whereby it is possible to achieve a reduction in cost through a reduction in the wall thickness of the portion.

Further, the rotation center 241*c* of the opening and closing cover 241 may be situated nearer to the front surface of the main body than the extension of the stress vector 234 exerted to the opening and closing cover 241 from the connection arm 227. In this case also, the opening and closing cover 241 receives a rotational moment in the closing direction due to the stress vector 234, so that, similarly, it is possible to reduce the possibility of the opening and closing cover 241 being opened by the stress from the connection arm 227.

As described above, as in the first exemplary embodiment, in the present exemplary embodiment, it is possible to provide a cartridge push-in mechanism with a sufficient level of strength while suppressing an increase in size and cost. Further, it is possible to reduce the possibility of the opening and closing cover 241 being opened by the stress from the connection arm 227, making it possible to reduce the possibility of the bosses 1*a* and 1*b* of the process cartridge 1 being detached from the rail portions 6*a* and 6*b* of the cartridge guides L and 6.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Applications No. 2010-082830 filed Mar. 31, 2010 and No. 2011-024020 filed Feb. 7, 2011, which are hereby incorporated by reference herein in their entirety.

What is claimed is:

1. An image forming apparatus having a main body to which a cartridge is attachable and detachable thereto, the image forming apparatus performing image formation with the cartridge mounted at an attached position, the image forming apparatus comprising:

an opening and closing member configured to move with respect to the main body between a closed position where the main body is closed and an opened position where the main body is open to allow attachment/detachment of the cartridge; and a cartridge abutment member supported by the opening and closing member configured to move with respect to the opening and closing member in conjunction with the movement of the opening and closing member and capable of abutting the cartridge to move the cartridge toward the attached position when the opening and closing member moves from the opened position toward the closed position, wherein the cartridge abutment member includes:

a cartridge abutment surface configured to abut the cartridge when the cartridge abutment member abuts the cartridge;

an opening and closing member abutment surface configured to abut the opening and closing member when the cartridge abutment member presses the cartridge, the opening and closing member abutment surface being substantially parallel to the cartridge abutment surface, and the opening and closing member abutment surface being disposed on a normal line of the cartridge abutment surface; and a force transmission portion configured to transmit the force from the cartridge abutment surface to the opening and closing member abutment surface when the cartridge presses the cartridge abutment surface, the force transmission portion including a portion connecting the cartridge abutment surface and the opening and closing member abutment surface by a straight line extending in a direction of the normal line the cartridge abutment surface.

2. The image forming apparatus according to claim 1, wherein the cartridge includes an abutment surface which is substantially parallel to the cartridge abutment surface and located opposite the cartridge abutment surface in a state in which the cartridge is at the attached position and the opening and closing member is at the closed position, and wherein, when the cartridge moves from a state in which the cartridge is at the attached position toward a state in which the cartridge is detached from the main body, the abutment surface moves substantially perpendicularly with respect to the cartridge abutment surface and abuts the cartridge abutment surface.

3. The image forming apparatus according to claim 2, further comprising:

a guide configured to guide the movement of the cartridge within the main body at the time of attachment/detachment of the cartridge, wherein the guide guides the movement of the cartridge so as to cause the cartridge to move substantially perpendicularly with respect to the cartridge abutment surface when the cartridge moves from the state in which the cartridge is at the attached position toward the state in which the cartridge is detached from the main body.

4. The image forming apparatus according to claim 1, wherein the opening and closing member moves by rotating about a rotation axis, and wherein a positional relationship between a rotation axis of the opening and closing member and an extension of a vector of a force the opening and closing member receives from a center point of the opening and closing member abutment surface of the cartridge abutment member is a relationship in which the force the opening and closing member receives from the opening and closing member abutment surface is not exerted so as to cause the opening and closing member to move from the closed position to the opened position.

5. The image forming apparatus according to claim 1, wherein the image formation is effected by transferring a toner image to a recording material and pressurizing the toner image to fix the toner image, wherein the image forming apparatus further comprises:

a pressurization fixing unit configured to pressurize and fix the toner image transferred to the recording material; and wherein the cartridge abutment member changes a pressurization force of the pressurization fixing unit by moving in conjunction with the movement of the opening and closing member.

6. The image forming apparatus according to claim 4, wherein the rotation axis of the opening and closing member is on a line including the vector of a force the opening and closing member receives from a center point of the opening and closing member abutment surface of the cartridge abutment member.

7. An image forming apparatus having a main body to which a cartridge is attachable and detachable thereto, the image forming apparatus performing image formation with the cartridge mounted at an attached position, the image forming apparatus comprising:

an opening and closing member configured to move with respect to the main body to move between a closed position where the main body is closed and an opened position where the main body is open to allow attachment/detachment of the cartridge; and a cartridge abutment member supported by the opening and closing member configured to move with respect to the opening and closing member in conjunction with the movement of the opening and closing member and capable of abutting the cartridge to regulate the cartridge to move in a direction in which the cartridge is detached from the main body when the cartridge is attached to the main body and the opening and closing member is at the closed position, wherein the cartridge abutment member includes:

a cartridge abutment surface configured to abut the cartridge when the cartridge abutment abuts the cartridge;

an opening and closing member abutment surface configured to abut the opening and closing member when the cartridge abutment member presses the cartridge the opening and closing member abutment surface being substantially parallel to the cartridge abutment surface, and the opening and closing member abutment surface being disposed on a normal line of the cartridge abutment surface; and a force transmission portion configured to transmit the force from the cartridge abutment surface to the opening and closing member abutment surface when the cartridge presses the cartridge abutment surface, the force transmission portion including a portion connecting the cartridge abutment surface the opening and closing member abutment surface by a straight line extending in a direction of the normal line of the cartridge abutment surface.

8. The image forming apparatus according to claim 7, wherein the cartridge includes an abutment surface which is substantially parallel to the cartridge abutment surface and located opposite the cartridge abutment surface in a state in which the cartridge is at the attached position and the opening and closing member is at the closed position, and when the cartridge moves from a state in which the cartridge is at the attached position toward a state in which the cartridge is detached from the main body, the abutment surface moves substantially perpendicularly with respect to the cartridge abutment surface and abuts the cartridge abutment surface.

9. The image forming apparatus according to claim 8, further comprising:

a guide configured to guide the movement of the cartridge within the main body at the time of attachment/detachment of the cartridge, wherein the guide guides the movement of the cartridge so as to cause the cartridge to move substantially perpendicularly with respect to the cartridge abutment surface when the cartridge moves from the state in which the cartridge is at the attached position toward the state in which the cartridge is detached from the main body.

10. The image forming apparatus according to claim 7, wherein the opening and closing member moves by rotating around a rotation axis, and wherein a positional relationship between the rotation axis of the opening and closing member and an extension of a vector of a force the opening and closing member receives from a center point of the opening and closing member abutment surface of the cartridge abutment member is a relationship in which the force the opening and closing member receives from the opening and closing member abutment surface is not exerted so as to cause the opening and closing member to move from the closed position to the opened position.

11. The image forming apparatus according to claim 7, wherein the image formation is effected by transferring a toner image to a recording material and pressurizing the toner image to fix the toner image, wherein the image forming apparatus further comprises:

a pressurization fixing unit configured to pressurize and fix the toner image transferred to the recording material, and wherein the cartridge abutment member changes a pressurization force of the pressurization fixing unit by moving in conjunction with the movement of the opening and closing member.

12. The image forming apparatus according to claim 10, wherein the rotation axis of the opening and closing member is on a line including the vector of a force the opening and closing member receives from a center point of the opening and closing member abutment surface of the cartridge abutment member.

* * * * *